US011059084B2

(12) United States Patent
Chen et al.

(10) Patent No.: US 11,059,084 B2
(45) Date of Patent: Jul. 13, 2021

(54) FORWARD AND BACKWARD EXTRUSION COMPOSITE FORMING METHOD USING MOULD HAVING OPEN INNER CAVITY

(71) Applicant: No.59 Research Institute of China Ordnance Industry, Chongqing (CN)

(72) Inventors: Qiang Chen, Chongqing (CN); Shuhai Huang, Chongqing (CN); Jun Lin, Chongqing (CN); Chuankai Hu, Chongqing (CN); Xiangsheng Xia, Chongqing (CN); Zude Zhao, Chongqing (CN); Yang Wu, Chongqing (CN)

(73) Assignee: NO.59 RESEARCH INSTITUTE OF CHINA ORDNANCE INDUSTRY, Chongqing (CN)

( * ) Notice: Subject to any disclaimer, the term of this patent is extended or adjusted under 35 U.S.C. 154(b) by 197 days.

(21) Appl. No.: 16/274,264

(22) Filed: Feb. 13, 2019

(65) Prior Publication Data

US 2020/0009628 A1 Jan. 9, 2020

(30) Foreign Application Priority Data

Jul. 9, 2018 (CN) ..... 201810743906.0

(51) Int. Cl.
*B21C 23/20* (2006.01)
*B21C 25/00* (2006.01)
(Continued)

(52) U.S. Cl.
CPC ..... *B21C 23/20* (2013.01); *B21C 25/00* (2013.01); *B21C 33/004* (2013.01); *B21C 23/21* (2013.01)

(58) Field of Classification Search
CPC ..... B21C 23/03; B21C 23/035; B21C 23/042; B21C 23/205; B21C 23/08; B21C 23/085;
(Continued)

(56) References Cited

U.S. PATENT DOCUMENTS 2,451,511 A * 10/1948 Rice ..... B21K 5/16 72/345
3,235,946 A * 2/1966 Neu ..... B21K 1/18 29/888.044
(Continued)

FOREIGN PATENT DOCUMENTS

FR 1307628 A * 10/1962 ..... B21C 23/21
FR 2224223 A1 * 10/1974 ..... B21K 1/26
(Continued)

*Primary Examiner* — Adam J Eiseman
*Assistant Examiner* — Dylan Schommer
(74) *Attorney, Agent, or Firm* — Bayramoglu Law Offices LLC

(57) ABSTRACT

The present invention discloses a forward and backward extrusion composite forming method using a mould having an open inner cavity, including the following steps: (1) the structural design and assembly of the forward and backward extrusion composite mould having the open inner cavity; (2) the preparation of the initial billet; and (3) forward and backward extrusion composite forming. The present invention can greatly improve the length-diameter ratio of the blind hole and is widely used in alloy steel, aluminum alloy, magnesium alloy, copper alloy and other components.

2 Claims, 5 Drawing Sheets

(51) Int. Cl.
*B21C 33/00* (2006.01)
*B21C 23/21* (2006.01)

(58) Field of Classification Search
CPC ..... B21C 23/14; B21C 23/142; B21C 23/18; B21C 23/183; B21C 23/212; B21C 23/21; B21C 25/00; B21C 33/004; B21D 45/02; B21D 45/04; B21D 45/06; B21D 45/08; B21D 45/10; B21D 22/06; B21D 22/08; B21D 22/10; B21D 22/105; B21D 22/24; B21D 37/04; B21D 37/06; B30B 11/02; B30B 11/027; B30B 11/04; B30B 11/22; B30B 11/221; B30B 11/26; B29C 55/30; B29C 2043/144; B29C 43/50
USPC ..... 264/323; 425/422, 412, 443
See application file for complete search history.

(56) References Cited

U.S. PATENT DOCUMENTS 3,362,206 A * 1/1968 Bertoglio ..... B21C 23/03 72/254
3,533,264 A * 10/1970 Quante ..... B21C 23/215 72/263
4,416,141 A * 11/1983 Nippert ..... B21C 23/03 72/345
4,787,234 A * 11/1988 Garyga ..... B21C 23/08 72/263
5,678,442 A * 10/1997 Ohba ..... B21C 23/21 72/272

FOREIGN PATENT DOCUMENTS

GB 546950 A * 8/1942 ..... B21C 23/21
GB 684735 A * 12/1952 ..... B21C 23/14
GB 1459641 A * 12/1976 ..... B21C 23/03
GB 1485328 A * 9/1977 ..... B21C 23/03
GB 2006075 A * 5/1979 ..... B21C 23/03

* cited by examiner

FORWARD AND BACKWARD EXTRUSION COMPOSITE FORMING METHOD USING MOULD HAVING OPEN INNER CAVITY

CROSS REFERENCE TO RELATED APPLICATIONS

This application is based upon and claims priority to Chinese Patent Application No. 201810743906.0, filed on Jul. 9, 2018, the entire contents of which are incorporated herein by reference.

TECHNICAL FIELD

The present invention relates to a forward and backward extrusion composite forming method using a mould having an open inner cavity.

BACKGROUND

At present, the hole formed by the traditional backward extrusion is not deep, and the length-diameter ratio of the inner hole of alloy steel is generally about 3. Although the length-diameter ratio of the blind hole of the billet can be increased by the traditional forward extrusion, the height-diameter ratio of the core mould cannot be too large (as shown in FIG. 1), otherwise, the core mould will become unstable. The traditional forward and backward extrusion methods cannot meet the requirement of forming components with blind holes having certain depth.

SUMMARY

The objective of the present invention is to provide a forward and backward extrusion composite forming method using an open inner mould cavity.

The present invention adopts the following method: a forward and backward extrusion composite forming method using an open inner mould cavity, characterized in that, including the following steps: preparing an initial billet; and performing forward and backward extrusion composite forming on the initial billet using a mould.

The mould includes a backward extrusion mould and a forward extrusion mould.

An upper mould of the backward extrusion mould includes a male mould, and the male mould is matched with a conical surface of an upper mould sleeve. An upper end surface of the male mould is in contact with a lower end surface of an upper cushion plate, and an upper end surface of the upper cushion plate is in contact with a lower end surface of an upper mould base. Upper ejector pins are evenly distributed along a central axis in the upper mould base, a punch of the male mould passes through an inner hole of a first male mould sleeve and forms a clearance fit with the first male mould sleeve, and the first male mould sleeve is connected to the upper mould sleeve by a sling.

A lower mould of the backward extrusion mould includes a female mould. Outer lower ejector pins evenly distributed along the central axis are horizontally inserted into a step-like pass-through slot at the bottom of the female mould, and then the female mould passes through an inner hole of a lower mould tube and is placed on an upper end surface of a lower mould base. The pin body of each of the outer lower ejector pins passes through the through-hole of the lower mould base. The female mould is in clearance fit with the lower mould tube, and the core mould is placed in an inner cavity of the female mould and forms a clearance fit with the female mould. A guide block is placed on an upper end surface of the core mould, and the guide block is in clearance fit with the female mould. A pressure plate is in contact with the guide block through steps, and the pressure plate and the female mould are tightly compressed together by screws. Then, a lower fixing block passes through a through-hole of the female mould and is placed on the upper end surface of the lower mould base, a center lower ejector pin passes through a pass-through slot of the lower fixing block, and a cushion block passes through a through-hole of the core mould and is placed on an upper end surface of the lower fixing block.

An upper mould of the forward extrusion mould includes a male mould, and the male mould is matched with a conical surface of an upper mould sleeve. An upper end surface of the male mould is in contact with a lower end surface of an upper cushion plate, and an upper end surface of the upper cushion plate is in contact with a lower end surface of an upper mould base. Upper ejector pins are evenly distributed along a central axis in the upper mould base, a punch of the male mould passes through an inner hole of a second male mould sleeve and forms a clearance fit with the second male mould sleeve, and the second male mould sleeve is connected to the upper mould sleeve by a sling.

A lower mould of the forward extrusion mould includes a female mould. Outer lower ejector pins evenly distributed along the central axis are horizontally inserted into a step-like pass-through slot at the bottom of the female mould, and then the female mould passes through an inner hole of a lower mould tube and is placed on an upper end surface of a lower mould base. The female mould is in clearance fit with the lower mould tube, and the core mould is placed in an inner cavity of the female mould and forms a clearance fit with the female mould. A guide block is placed on an upper end surface of the core mould, and the guide block is in clearance fit with the female mould. A pressure plate is in contact with the guide block through steps, and the pressure plate and the female mould are tightly compressed to each other by screws. Then, a lower fixing block passes through a through-hole of the female mould and is placed on the upper end surface of the lower mould base, a center lower ejector pin passes through a pass-through slot of the lower fixing block, and a support block passes through the inner hole of the lower mould tube to form a clearance fit with the lower mould tube and is placed between the lower mould base and the female mould.

The forward and backward extrusion composite forming method using the mould having the open inner cavity is as follows. First, the billet is placed inside the cavity of the core mould before starting the backward extrusion, and there is open space between the billet and the bottom of the cavity. Before the male mould goes down and contacts the billet, the first male mould sleeve and the guide block form a mould orifice guide. As the male mould continues to go down and press the billet down to fill the bottom of the cavity, the metal flows upward along the inner wall of the core mould. When the male mould reaches a designed displacement, the male mould maintains pressure and stops. The outer lower ejector pins evenly distributed along the central axis drive the female mould to move upward, and the wall thickness of the metal is reduced by the stepped surface of the core mould. When the stepped surface of the core mould is located above the lower end surface of the straight wall of the male mould, the outer lower ejector pins stop moving upward. Then, the sling is removed, the first male mould sleeve is disconnected with the upper mould sleeve, pressure is maintained in the upper ejector pins evenly distributed along the central axis, and the male mould returns upwardly. The pressure of the upper ejector pins is transmitted to the first male mould sleeve, forcing the billet to fall off the male mould, and the picking-up operation is completed under the action of upward ejecting of the center lower ejector pin.

Subsequently, before starting the forward extrusion, the above-mentioned billet, which is subjected to the backward extrusion, is placed inside the cavity of the core mould. Before the male mould goes down and contacts the billet, the second male mould sleeve and the guide block form a mould orifice guide. Then, the sling is removed, the second male mould sleeve is disconnected with the upper mould sleeve, meanwhile, the upper end surface of the second male mould sleeve is in contact with the stepped surface of the male mould. When the second male mould sleeve is in contact with an end surface of the wall of the billet, the pressure of the male mould is transmitted to the second male mould sleeve, forcing the metal to flow downward to cause a neck deformation. At the same time, the bottom of the billet is gradually separated from the male mould, and thereby forming a certain open space. When the male mould reaches a designed displacement, the male mould maintains pressure and stops. Then, the pressure on the upper ejector pins evenly distributed along the central axis is maintained, and the male mould returns upwardly. The pressure of the upper ejector pins is transmitted to the second male mould sleeve, forcing the billet to fall off the male mould, and the picking-up operation is completed under action of the upward ejecting of the center lower ejector pin.

The deformation amount of a single forward extrusion is less than or equal to 65%, and when the deformation amount is more than 65%, a plurality of forward extrusion deformations are carried out.

The present invention is a new method, in which, based on the conventional forward and backward extrusion, the process of making the wall thickness thin is added in the backward extrusion process, and the step of the thinned portion is ensured to be located on the straight wall of the bottom of the billet. The method provides a billet preparation for the subsequent forward extrusion, and meanwhile, solves the problem of bending instability of the metal horizontal flow during forward extrusion. Then, combined with a novel method for wall thickness necking in the forward extrusion process, the method is not limited by the length of the core mould, which can greatly improve the length-diameter ratio of the blind hole.

Figure 1:
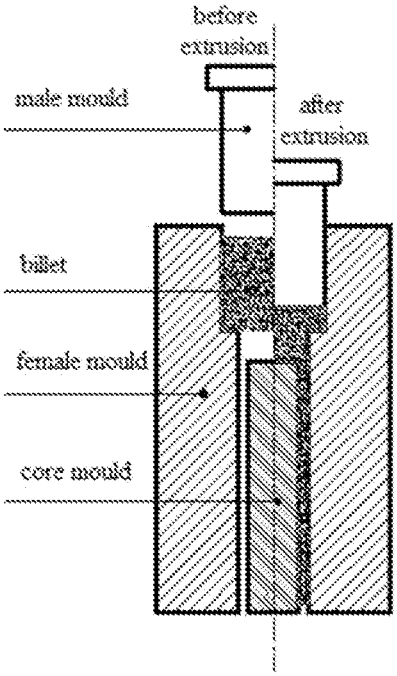
Fig. 1 (Prior Art)
FIG. 1 is a schematic diagram of a mould of a conventional forward extrusion.

In the drawings, 1—upper ejector pin; 2—upper mould base; 3—upper cushion plate; 4—upper mould sleeve; 5—male mould; 6—pressure plate; 7—guide block; 8—female mould; 9—core mould; 10—lower mould tube; 11—lower fixing block; 12—lower mould base; 13—center lower ejector pin; 14—outer lower ejector pin; 15—cushion block; 16—first male mould sleeve; 17—second male mould sleeve; 18—support block; 19—step-like pass-through slot; 20—pass-through slot; 21—punch; and 22—sling.

DETAILED DESCRIPTION OF THE EMBODIMENTS

The embodiments of the present invention will be described below with reference to the drawings.

Figure 2:
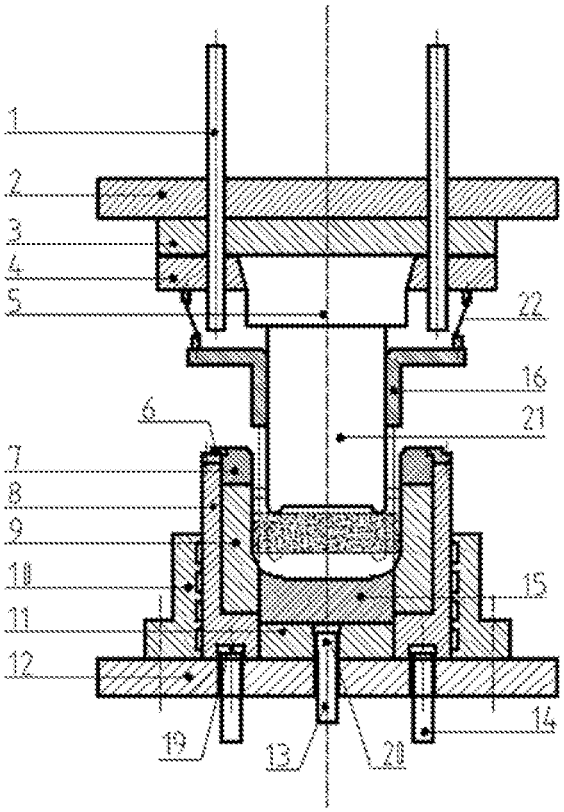
FIG. 2 is a schematic diagram of a mould of a backward extrusion.

Taking the steel part in FIG. 2 as an example, the structural design and assembly of the forward and backward extrusion composite mould having the open inner cavity are performed. FIG. 2 shows a structure of a mould of a backward extrusion. An upper mould of the backward extrusion mould includes a male mould 5, and the male mould 5 is matched with a conical surface of an upper mould sleeve 4. An upper end surface of the male mould 5 is in contact with a lower end surface of an upper cushion plate 3, and an upper end surface of the upper cushion plate 3 is in contact with a lower end surface of an upper mould base 2. Upper ejector pins 1 are evenly distributed along a central axis in the upper mould base 2, a punch of the male mould 5 passes through an inner hole of a first male mould sleeve 16 and forms a clearance fit with the first male mould sleeve 16, and the first male mould sleeve 16 is connected to the upper mould sleeve 4 by a sling.

A lower mould of the backward extrusion mould includes a female mould 8. Outer lower ejector pins 14 evenly distributed along the central axis are horizontally inserted into a step-like pass-through slot at the bottom of the female mould 8, and then the female mould 8 passes through an inner hole of a lower mould tube 10 and is placed on an upper end surface of a lower mould base 12. The pin body of each of the outer lower ejector pins 14 passes through the through-hole of the lower mould base 12. The female mould 8 is in clearance fit with the lower mould base 12, and the core mould 9 is placed in an inner cavity of the female mould 8 and forms a clearance fit with the female mould 8. A guide block 7 is placed on an upper end surface of the core mould 9, and the guide block 7 is in clearance fit with the female mould 8. A pressure plate 6 is in contact with the guide block 7 through steps, and the pressure plate 6 and the female mould 8 are tightly compressed to each other by screws. Then, a lower fixing block 11 passes through a through-hole of the female mould 8 and is placed on the upper end surface of the lower mould base 12, a center lower ejector pin 13 passes through a pass-through slot of the lower fixing block 11, and a cushion block 15 passes through a through-hole of the core mould 9 and is placed on an upper end surface of the lower fixing block 11.

Figure 3:
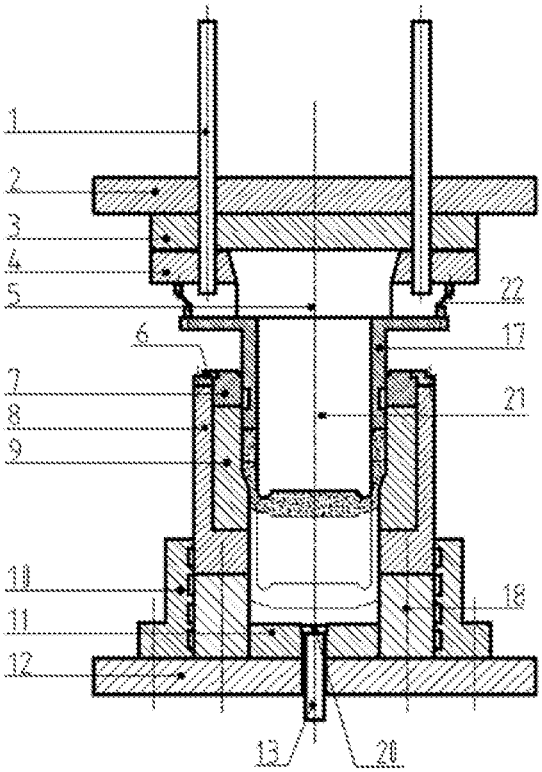
FIG. 3 is a schematic diagram of a mould of a forward extrusion.

FIG. 3 shows a structure of a mould of a forward extrusion. The difference between the upper mould of the forward extrusion mould and the upper mould of the backward extrusion mould is that, in the upper mould of the forward extrusion mould, after the first male mould sleeve 16 is replaced with a second male mould sleeve 17, the punch of the male mould 5 passes through an inner hole of the second male mould sleeve 17 and forms a clearance fit with the second male mould sleeve 17, and the second male mould sleeve 17 is connected to the upper mould sleeve 4 by a sling.

The difference between the lower mould of the forward extrusion mould and the lower mould of the backward extrusion mould is that, in the lower mould of the forward extrusion mould, a support block 18 is added, the support block 18 passes through the inner hole of the lower mould tube 10 to form a clearance fit with the lower mould tube 10, and is placed between the lower mould base 12 and the female mould 8; meanwhile, the outer lower ejector pins 14 and the cushion block 15 are removed.

Next, an initial billet is prepared, and the initial billet has a diameter of 782 mm, a height of 212 mm and an initial temperature of 1050° C.

Subsequently, the forward and backward extrusion composite forming test is carried out. The deformation amount of the backward extrusion is 62.9%, and the deformation amount of the forward extrusion is 51%, and a one pass of composite forming may be used. The process of the forward and backward extrusion composite forming using the mould having the open inner cavity mainly includes the following steps.

Figure 4A:
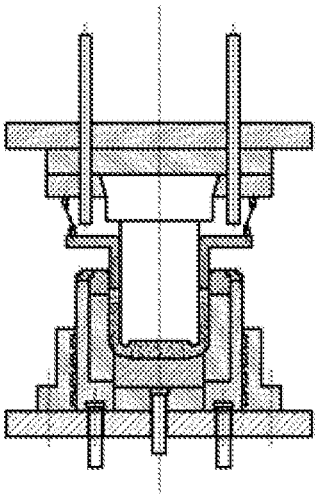
FIG. 4*a* is a schematic diagram showing a downward backward extrusion in an extruding process of a backward extrusion forming.

(a) Backward extrusion. First, before starting the backward extrusion, the billet is placed inside the cavity of the core mould 9, and there is an open space between the billet and the bottom of the cavity. Before the male mould 5 goes down and contacts the billet, the first male mould sleeve 16 and the guide block 7 form a mould orifice guide. As the male mould 5 continues to go down and press the billet down at a speed of 30 mm/s to fill the bottom of the cavity, the metal flows upward along the inner wall of the core mould 9. When the male mould 5 reaches a displacement of 251 mm, the male mould 5 maintains pressure and stops (as shown in FIG. 4*a*).

Figure 4B:
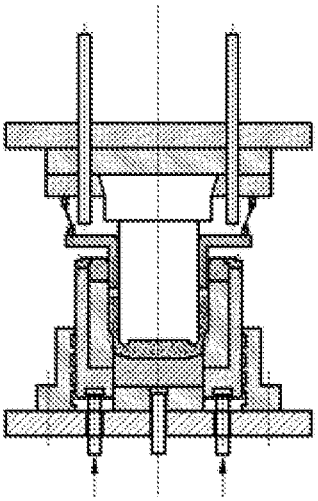
FIG. 4*b* is a schematic diagram showing an upward reduction of a wall thickness in an extruding process of a backward extrusion forming.

The outer lower ejector pins 14 evenly distributed along the central axis drive the female mould 8 to move upward at a speed of 20 mm/s, and the wall thickness of the metal is reduced by the stepped surface of the core mould 9. When the movement displacement is 100 mm, that is, when the stepped surface of the core mould 9 is located above the lower end surface of the straight wall of the male mould 5, the outer lower ejector pins 14 stop moving upward (as shown in FIG. 4*b*).

Figure 4C:
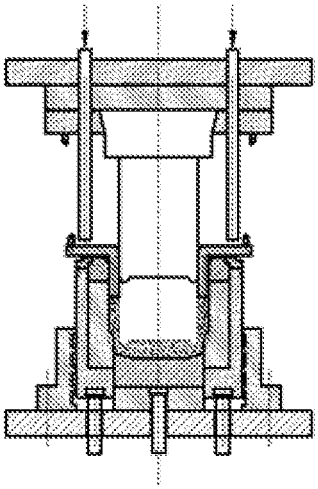
FIG. 4*c* is a schematic diagram showing an unloading in an extruding process of a backward extrusion forming.

Then, the sling is removed, the first male mould sleeve 16 is disconnected with the upper mould sleeve 4, the pressure on the upper ejector pins 1 evenly distributed along the central axis is maintained, and the male mould 5 returns upwardly. The pressure of the upper ejector pins 1 is transmitted to the first male mould sleeve 16, forcing the billet to fall off the male mould 5, and the picking-up operation is completed under the action of upward ejecting of the center lower ejector pin 13 (as shown in FIG. 4*c*).

Figure 5A:
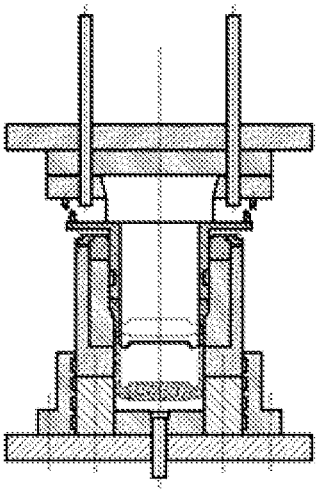
FIG. 5*a* is a schematic diagram showing an extruding process of a forward extrusion forming.

(b) Forward extrusion. Subsequently, before starting the forward extrusion, the above-mentioned billet, which is subjected to the backward extrusion, is placed inside the cavity of the core mould 9. Before the male mould 5 goes down and contacts the billet, the second male mould sleeve 17 and the guide block 7 form a mould orifice guide. Then, the sling is removed, the second male mould sleeve 17 is disconnected with the upper mould sleeve 4; meanwhile, the upper end surface of the second male mould sleeve 17 is in contact with the stepped surface of the male mould 5. When the second male mould sleeve 17 is in contact with an end surface of the wall of the billet, the pressure formed by the male mould 5 at a moving speed of 30 mm/s is transmitted to the second male mould sleeve 17 to force the metal to flow downward to cause a neck deformation. At the same time, the bottom of the billet is gradually separated from the male mould 5, and thereby forming a certain open space. When the male mould 5 reaches a displacement of 180 mm, the male mould 5 maintains pressure and stops (as shown in FIG. 5*a*).

Figure 5B:
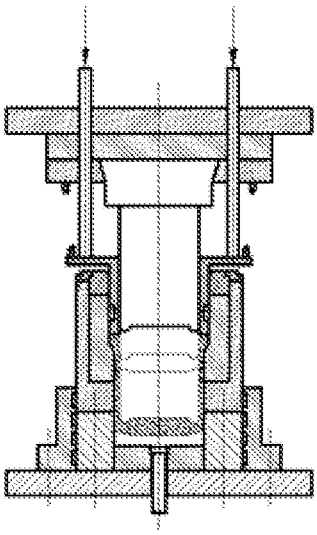
FIG. 5*b* is a schematic diagram showing an unloading in an extruding process of a forward extrusion forming.

Then, the pressure on the upper ejector pins 1 evenly distributed along the central axis is maintained, and the male mould 5 returns upwardly. The pressure of the upper ejector pins 1 is transmitted to the second male mould sleeve 17, forcing the billet to fall off the male mould 5 (as shown in FIG. 5*b*).

Figure 5C:
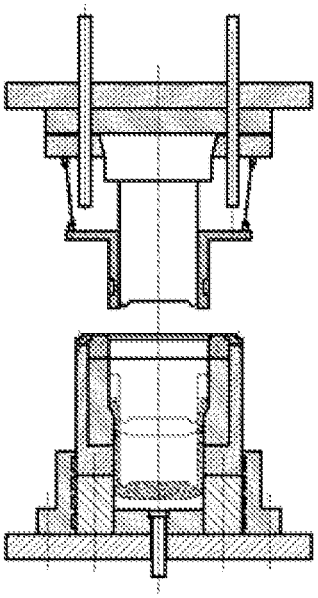
FIG. 5*c* is a schematic diagram showing a picking-up in an extruding process of a forward extrusion forming.

At this time, the second male mould sleeve 17 is connected to the upper mould sleeve 4 by a sling, which further returns upwardly along with the male mould 5, the second male mould sleeve 17 and the male mould 5 are separated from the lower mould, and the picking-up operation is completed under the action of upward ejecting of the center lower ejector pin 13 (as shown in FIG. 5*c*).

What is claimed is:

1. A forward and backward extrusion composite forming method using a mould having an open inner cavity, comprising the following steps: preparing an initial billet; and performing a forward and backward extrusion composite forming on the initial billet using the mould; wherein the mould comprises a forward extrusion mould and a backward extrusion mould; and wherein an upper mould of the backward extrusion mould comprises a male mould, and wherein the male mould is matched with a conical surface of an upper mould sleeve; an upper end surface of the male mould is in contact with a lower end surface of an upper cushion plate, and an upper end surface of the upper cushion plate is in contact with a lower end surface of an upper mould base; upper ejector pins are evenly distributed along a central axis in the upper mould base, a punch of the male mould passes through an inner hole of a first male mould sleeve and forms a clearance fit with the first male mould sleeve, and the first male mould sleeve is connected to the upper mould sleeve by a sling of the backward extrusion mould;

a lower mould of the backward extrusion mould comprises a female mould, and wherein outer lower ejector pins evenly distributed along the central axis are horizontally inserted into a step-like pass-through slot at a bottom of the female mould, and then the female mould passes through an inner hole of a lower mould tube and is placed on an upper end surface of a lower mould base; a pin body of each of the outer lower ejector pins passes through a through-hole of the lower mould base; the female mould is in clearance fit with the lower mould tube, and a core mould is placed in an inner cavity of the female mould and forms a clearance fit with the female mould; a guide block is placed on an upper end surface of the core mould, and the guide block is in clearance fit with the female mould; a pressure plate is in contact with the guide block through steps, and the pressure plate and the female mould are tightly compressed to each other by screws; then, a lower fixing block passes through a through-hole of the female mould and is placed on the upper end surface of the lower mould base, a center lower ejector pin passes through a pass-through slot of the lower fixing block, and a cushion block passes through a through-hole of the core mould and is placed on an upper end surface of the lower fixing block;

an upper mould of the forward extrusion mould comprises the male mould, and wherein the male mould is matched with the conical surface of the upper mould sleeve; the upper end surface of the male mould is in contact with the lower end surface of the upper cushion plate, and the upper end surface of the upper cushion plate is in contact with the lower end surface of the upper mould base; the upper ejector pins are evenly distributed along the central axis in the upper mould base, the punch of the male mould passes through an inner hole of a second male mould sleeve and forms a clearance fit with the second male mould sleeve, and the second male mould sleeve is connected to the upper mould sleeve by a sling of the forward extrusion mould;

a lower mould of the forward extrusion mould comprises the female mould; and wherein the outer lower ejector pins evenly distributed along the central axis are horizontally inserted into the step-like pass-through slot at the bottom of the female mould, and then the female mould passes through the inner hole of the lower mould tube and is placed on the upper end surface of the lower mould base; the female mould is in clearance fit with the lower mould base, and the core mould is placed in the inner cavity of the female mould and forms the clearance fit with the female mould; the guide block is placed on the upper end surface of the core mould, and the guide block is in clearance fit with the female mould; the pressure plate is in contact with the guide block through steps, and the pressure plate and the female mould are tightly compressed to each other by the screws; then, the lower fixing block passes through the through-hole of the female mould and is placed on the upper end surface of the lower mould base, the center lower ejector pin passes through the pass-through slot of the lower fixing block, and a support block passes through the inner hole of the lower mould tube to form a clearance fit with the lower mould tube and is placed between the lower mould base and the female mould; and the forward and backward extrusion composite forming method using the mould having the open inner cavity further comprises the following steps:

first, before starting the backward extrusion, the initial billet is placed inside the open inner cavity of the core mould, and there is an open space between the initial billet and the bottom of the open inner cavity; before the male mould goes down and contacts the billet, the first male mould sleeve and the guide block form a mould orifice guide; as the male mould continues to go down and press the initial billet down to fill the bottom of the open inner cavity, the metal flows upward along the inner wall of the core mould; when the male mould reaches a designed displacement, the male mould maintains pressure and stops; the outer lower ejector pins evenly distributed along the central axis drive the female mould to move upward, and the wall thickness of the metal is reduced by a stepped surface of the core mould; when the stepped surface of the core mould is located above the lower end surface of a straight wall of the male mould, the outer lower ejector pins stop moving upward; then, a first billet is obtained and the sling of the backward extrusion mould is removed, the first male mould sleeve is disconnected with the upper mould sleeve, a pressure on the upper ejector pins evenly distributed along the central axis is maintained, and the male mould returns upwardly; and the pressure of the upper ejector pins is transmitted to the first male mould sleeve, forcing the first billet to fall off the male mould, and a picking-up operation of the first billet is completed under an action of upward ejecting of the center lower ejector pin;

subsequently, before starting the forward extrusion, the initial billet subjected to the backward extrusion is placed inside the open inner cavity of the core mould; before the male mould goes down and contacts the first billet, the second male mould sleeve and the guide block form a mould orifice guide; then, the sling of the forward extrusion mould is removed, the second male mould sleeve is disconnected with the upper mould sleeve; meanwhile, the upper end surface of the second male mould sleeve is in contact with a stepped surface of the male mould; when the second male mould sleeve is in contact with an end surface of a wall of the first billet, the pressure of the male mould is transmitted to the second male mould sleeve, forcing the metal to flow downward to cause a neck deformation; at the same time, the bottom of the first billet is gradually separated from the male mould, and thereby forming a certain open space; when the male mould reaches the designed displacement, the male mould maintains pressure and stops; then, a second billet is obtained and the pressure on the upper ejector pins evenly distributed along the central axis is maintained, and the male mould returns upwardly; and the pressure of the upper ejector pins is transmitted to the second male mould sleeve, forcing the second billet to fall off the male mould, and a picking-up operation of the second billet is completed under the action of upward ejecting of the center lower ejector pin.

2. The forward and backward extrusion composite forming method using the mould having the open inner cavity of claim 1, wherein a deformation amount of a single forward extrusion is less than or equal to 65%, and when the deformation amount is more than 65%, a plurality of forward extrusion deformations are carried out.

* * * * *